US007821686B2

(12) United States Patent
Sharma et al.

(10) Patent No.: US 7,821,686 B2
(45) Date of Patent: Oct. 26, 2010

(54) PAPER FEEDER

(75) Inventors: Nidhi Sharma, Brampton (CA); Petrus T. De Koning, Toronto (CA); Guillermo Aristizabal, Toronto (CA); Raymond M. Ruthenberg, Toronto (CA); Gary A. Faguy, Hamilton (CA)

(73) Assignee: Xerox Corporation, Norwalk, CT (US)

( * ) Notice: Subject to any disclaimer, the term of this patent is extended or adjusted under 35 U.S.C. 154(b) by 1527 days.

(21) Appl. No.: 11/158,092

(22) Filed: Jun. 21, 2005

(65) Prior Publication Data

US 2007/0001371 A1 Jan. 4, 2007

(51) Int. Cl.
*H04N 1/04* (2006.01)
*B65H 5/22* (2006.01)

(52) U.S. Cl. ..... 358/498; 271/4.02; 271/4.03; 271/4.08

(58) Field of Classification Search ..... 358/498; 271/10.13

See application file for complete search history.

(56) References Cited

U.S. PATENT DOCUMENTS

| | | | | |
|---|---|---|---|---|
| 3,905,458 | A | 9/1975 | Mehrbrodt | |
| 3,934,690 | A | 1/1976 | Janning | |
| 5,435,538 | A * | 7/1995 | Billings et al. | 271/34 |
| 5,443,359 | A * | 8/1995 | Miller et al. | 414/798.9 |
| 5,906,767 | A * | 5/1999 | Karol et al. | 252/62.52 |
| 6,059,279 | A * | 5/2000 | Wenthe, Jr. | 271/10.13 |
| 6,595,512 | B2 | 7/2003 | de Koning et al. | |
| 7,036,815 | B2 * | 5/2006 | Yamamoto | 271/124 |

* cited by examiner

*Primary Examiner*—Edward L Coles
*Assistant Examiner*—Neil R McLean

(57) ABSTRACT

A paper feeder employs a retard roll mounted on a shaft that is controlled by a magneto rheological variable clutch. Current is adjusted to the magneto rheological variable clutch to produce a variable drag torque (from near zero to fully locked) on the retard roll. The current is adjusted based on various inputs, some of which include media type, temperature, humidity, media size, and transport speed. Variable drag on the retard roll results in a reduction in induced skew of sheet passing through a nip formed between the retard roll and a separation roll, as well as, less and more consistent wear of the retard roll.

15 Claims, 6 Drawing Sheets

PAPER FEEDER

This invention relates in general to an image forming apparatus, and more particularly, to an image forming apparatus including a paper feeder employing an improved variable torque retard roll.

Heretofore, paper feeders in printers have used magnetic particle brakes, wrap spring clutches and hysteresis clutches in active and semi-active feed heads. In these feed head systems, the drag torque is fixed. Thus, the design, intent torque is a compromise between the ideal torque for various media types and across various environmental conditions, which results in less than optimum paper feeding performance. These retard feeders rely on an elastomeric retard roll to prevent feeding multiple sheets. This roll must use a material that has a high coefficient of friction and be resistant to contamination. Typically, this results in the use of materials with a high wear rate. The resisting force that the retard roll imparts to the feed nip is a product of the normal force and the coefficient of friction of the material, and has an upper limit which is set by the resisting torque applied to the retard roll. The resisting torque is applied through the aforementioned magnetic particle brakes, wrap spring clutches and hysteresis clutches.

Typical implementation of retard feeders of this type includes creating a normal force on the nip which is constant over a large range and provide sufficient material on the retard roll to wear. The limiting factor then becomes the fixed resisting torque value since, as the retard roll wears, the moment arm from the nip to the retard roll axis reduces and the force required to turn the retard roll increases. The force required to rotate the retard roll increases to a level that is out of the operation window of the system. This results in a retard roll that must be replaced more often than is desirable.

For example, some retard rolls used in prior paper feeders employed standard magnetic wrap spring clutches that normally include a continuously running input member in the form of a hub and a normally stationary output shaft. When the clutch is activated, the hub is coupled to the output shaft for driving the same. In these clutches, the input hub is axially aligned with the output shaft and a helical spring having one end secured to either the hub or shaft member and has a number of turns of the spring surrounding the other member. When the free end of the spring is activated to tighten on the member it surrounds, a driving connection is imparted to that member. Activation is achieved by means of an electromagnetic coil, which is generally arranged to surround the hub and shaft and the coil spring. Upon energization of the coil, an intermediate member which is magnetically actuated by the coil acts upon the spring causing it to tighten on the associated member, usually the output shaft thereby producing the driving connection.

Other prior paper feeders have employed retard rolls that include a simple passive wrap spring mounted on the shaft of the retard roll as a clutch. A problem with this approach is that it is difficult to control the drag on the retard roll over the life of the retard roll. That is, there is a problem with compensating for wear out and changes in friction over the life of the retard roll.

An example of the known art is described in U.S. Pat. No. 3,905,458, which discloses an electromagnetically actuated spring wrap clutch having a coil spring adapted for wrapping around an output member and the field winding for an electromagnetic device surrounding the coil spring. Similarly, in U.S. Pat. No. 3,934,690, an electromagnetic coil of relatively large diameter surrounds the coil spring of relatively small diameter in a wrap spring clutch arrangement. Problems with retard rolls using wrap spring clutches, magnetic particle brakes, and hysteresis clutches include the fact that they typically wear too quickly and utilize a fixed torque for sheet separation regardless of sheet type or environmental condition. In addition, reaction time is insufficient to keep pace with present day high-speed printers.

Obviously, it would be advantageous to adjust the retard drag torque to an optimum value in order to reduce misfeeds/multifeeds, reduce roller wear, enhance feeding of delicate media, and to take into account the type of paper, size of paper and environmental conditions, such as, humidity and temperature.

Accordingly, an improved apparatus and method for providing controllable torque to a retard roll employed in paper feeders is disclosed that includes mounting the retard roll on a shaft that is controlled by a magneto rheological variable clutch. Current is adjusted to the magneto rheological variable clutch to produce a variable drag torque (from near zero to fully locked) on the retard roll. The current is adjusted based on various inputs, some of which include media type, temperature, humidity, media size, and transport speed. Variable drag on the retard roll results in a reduction in induced skew of sheet passing through a nip formed between the retard roll and a separation roll, as well as, less and more consistent wear of the retard roll.

In an alternative compensating torque retard feeder, a retard roll is attached to a pivoting bracket and loaded against a feed roll. An initial resisting torque is provided by a hysteresis clutch that includes a permanent magnet rotor and a cylinder movable over the surface of the rotor to decrease the applied torque as the retard roll wears. The pivoting bracket is connected to the movable cylinder and s the retard roll wears and the diameter changes, the angle of the pivoting bracket changes and moves the cylinder to thereby control the amount of overlap of the rotor and cylinder in the hysteresis clutch and thus, the torque applied to the retard roll. This allows the resisting torque to be constant as the retard roll wears.

The disclosed reprographic system that incorporates the disclosed improved paper feeder may be operated by and controlled by appropriate operation of conventional control systems. It is well-known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

The term 'printer' or 'reproduction apparatus' as used herein broadly encompasses various printers, copiers or multifunction machines or systems, xerographic or otherwise, unless otherwise defined in a claim. The term 'sheet' herein refers to any flimsy physical sheet or paper, plastic, or other useable physical substrate for printing images thereon, whether precut or initially web fed. A compiled collated set of printed output sheets may be alternatively referred to as a document, booklet, or the like. It is also known to use interposes or inserters to add covers or other inserts to the compiled sets.

As to specific components of the subject apparatus or methods, or alternatives therefor, it will be appreciated that, as normally the case, some such components are known per se in other apparatus or applications, which may be additionally or alternatively used herein, including those from art cited herein. For example, it will be appreciated by respective engineers and others that many of the particular components mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific embodiments, including the drawing figures (which are approximately to scale) wherein.

Figure 1:
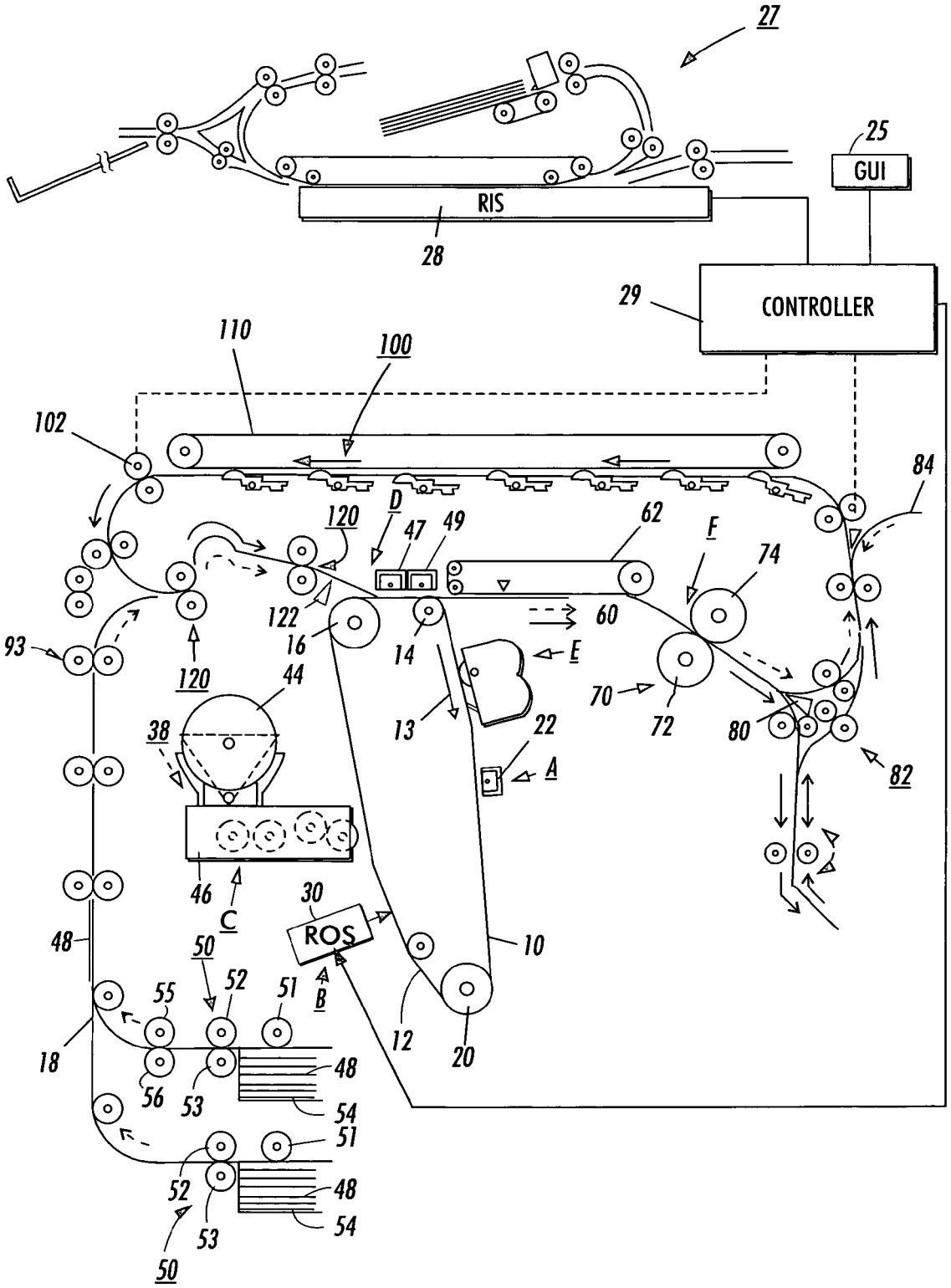
FIG. 1 is an exemplary xerographic printer that includes the improved retard feeder system of the present disclosure.
Figure 2:
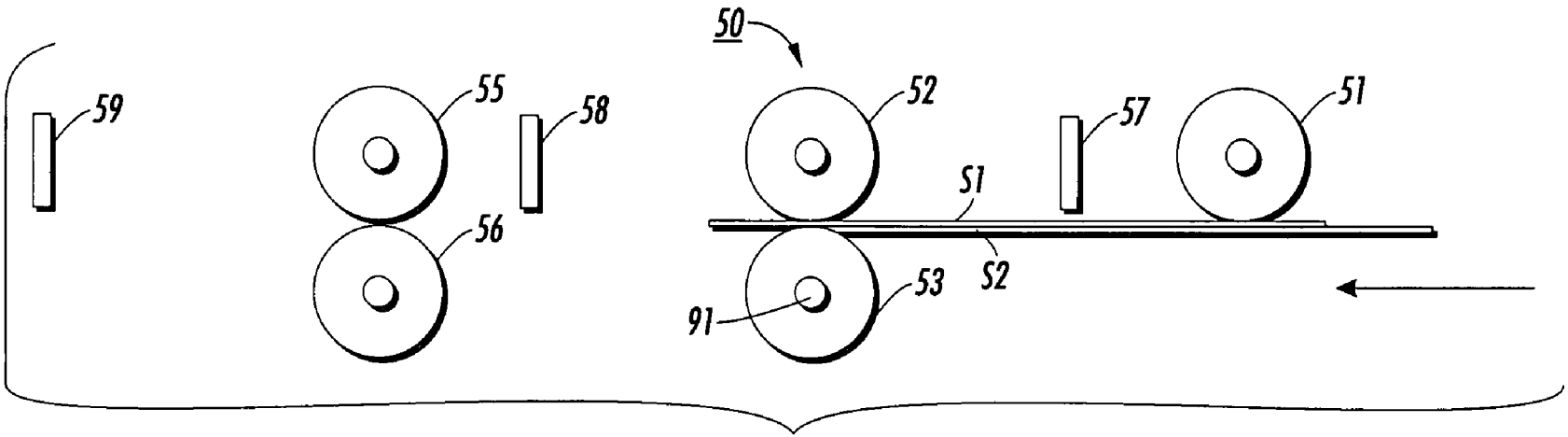
FIG. 2 is an exploded, partial schematic side view of a one embodiment of the improved retard sheet feeder apparatus of the disclosure.

While the disclosure will be described hereinafter in connection with preferred embodiments thereof, it will be understood that limiting the disclosure to those embodiments is not intended. On the contrary, it is intended to cover all alternatives, modifications and equivalents as may be included within the spirit and scope of the disclosure as defined by the appended claims.

The disclosure will now be described by reference to a xerographic printing apparatus that includes an improved retard feeder apparatus.

For a general understanding of the features of the disclosure, reference is made to the drawings. In the drawings, like reference numerals have been used throughout to identify identical elements.

Referring to FIG. 1 of the drawings, an original document is positioned in a document handler 27 on a raster input scanner (RIS) indicated generally by reference numeral 28. The RIS contains document illumination lamps, optics, a mechanical scanning drive and a charge couple device (CCD) array. The RIS captures the entire original document and converts it to a series of raster scan lines. This information is transmitted to an electronic subsystem (ESS) which controls a raster output scanner (ROS) described below.

FIG. 1 schematically illustrates an electrophotographic printing machine which generally employs a photoconductive belt 10. Preferably, the photoconductive belt 10 is made from photoconductive material coated on a ground layer, which, in turn, is coated on an anti-curl backing layer. Belt 10 moves in the direction of arrow 13 to advance successive portions sequentially through the various processing, stations disposed about the path of movement thereof. Belt 10 is entrained about stripping roller 14, tensioning roller 20 and drive roller 16. As roller 16 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or grayscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station, C, where toner, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 44, dispenses toner particles into developer housing 46 of developer unit 38.

With continued reference to FIG. 1, after the electrostatic latent image is developed, the toner powder image present on belt 10 advances to transfer station D. A print sheet 48 is advanced to the transfer station, D, by a sheet feeding apparatus, 50. Preferably, sheet feeding apparatus 50 includes a nudger roll 51 which feeds the uppermost sheet of stack 54 to a nip formed by feed roll 52 and a retard roll 53. Retard roll 53 is shaft mounted and controlled by controller 29 through a magneto rheological clutch that will be described hereinafter. Feed roll 52 rotates to advance the sheet from stack 54 into vertical transport 18. Vertical transport 18 directs the advancing sheet 48 of support material into the registration transport 120 which, in turn, advances the sheet 48 past image transfer station D to receive an image from photoconductive belt 10 in a timed sequence so that the toner powder image formed thereon contacts the advancing sheet 48 at transfer station D. Transfer station D includes a corona generating device 47 which sprays ions onto the back side of sheet 48. This attracts the toner powder image from photoconductive surface 12 to sheet 48. The sheet is then detacked from the photoreceptor by corona generating device 49 which sprays oppositely charged ions onto the back side of sheet 48 to assist in removing the sheet from the photoreceptor. After transfer, sheet 48 continues to move in the direction of arrow 60 by way of belt transport 62, which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roller 72. The pressure roller is cammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent transfers to a donor roll (not shown) and then to the fuser roll 72.

The sheet then passes through fuser 70 where the image is permanently fixed or fused to the sheet. After passing through fuser 70, a gate 80 either allows the sheet to move directly via output 84 to a finisher of stacker, or deflects the sheet into the duplex path 100, specifically, first into single sheet inverter 82 here. That is, if the sheet is either a simplex sheet or a completed duplex sheet having both side one and side two images formed thereon, the sheet will be conveyed via gate 80 directly to output 84. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transport 110, for recirculation back through transport station D and fuser 70 for receiving and permanently fixing the side two image to the backside of that duplex sheet, before it exits via exit path 84.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the non-transferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor that controls all of the machine functions hereinbefore described. The controller provides a comparison count of the copy sheets, the number of documents being recirculated, the number of documents being recirculated, the number of copy sheets selected by the operator, time delays, jam corrections, receive signals from full width or partial width array sensors and calculate skew in sheets passing over the sensors, calculate the change in skew, the speed of the sheet and an overall comparison of the detected motion of sheets with a reference or nominal motion through a particular portion of the machine.

Sheet separator/feeder 50 is a friction retard top sheet feeder that will now be described with particular reference to FIGS. 2-5. Sheets 48 are fed from a stack by nudger roll 51 which engages the top sheet in the stack, and on rotation feeds the top sheet towards a nip formed between separation or feed roll 52 and retard roll 53. Feeding from tray 54 by nudger roll 51 is obtained by creating a stack normal force (e.g., of 1.5 Newtons) between the nudger roll and the paper stack. This force is achieved by the weight of the nudger wheel and its associated components acting under gravity.

At the beginning of a print cycle, the machine logic will interrogate the system to determine if any paper is in the paper path. If there is no paper in the paper path, the logic will initiate a signal to a feed clutch in nudger 51, thereby starting the feeder. The nudger roll 51 will drive the top sheet of paper 48 into the nip between feed roll 52 and retard roll 53. Microswitch 57 indicates when a sheet has been forwarded by the nudger roll. As the feed roll rotates, it drags a sheet of paper from the stack. Frictional forces and static electricity between the sheet of paper in the stack may cause several sheets to move into the nip together.

If several sheets of paper approach the nip together, the friction between the retard roll 53 and the bottom sheet of those being fed is greater than that between two sheets. The friction between the feed roll 52 and the top sheet S1 is greater than the friction between two sheets. The group of sheets being fed towards the nip will therefore tend to become staggered around the curved surface of the retard roll up into the nip, until the lower sheet S2 of the top two sheets is retained by the retard roll 53, while the topmost sheet is fed by the feed roll 52. Of course, in order for this to happen, the friction between the feed roll 52 and a paper sheet must be greater than the friction between a paper sheet and the retard roll 53. Therefore, the feed roll 52 drives the top sheet S1 away from the stack, and the next sheet S2 is retained in the nip to be fed next. Microswitch 58 communicates to controller whether a sheet has reached that point in feeding.

The feed clutch remains energized until paper is sensed by the input microswitch 59. Paper whose leading edge has reached this switch 59 is under the control of the takeaway rolls 55, 56 that drive the sheet towards registration transport 120.

Figure 3:
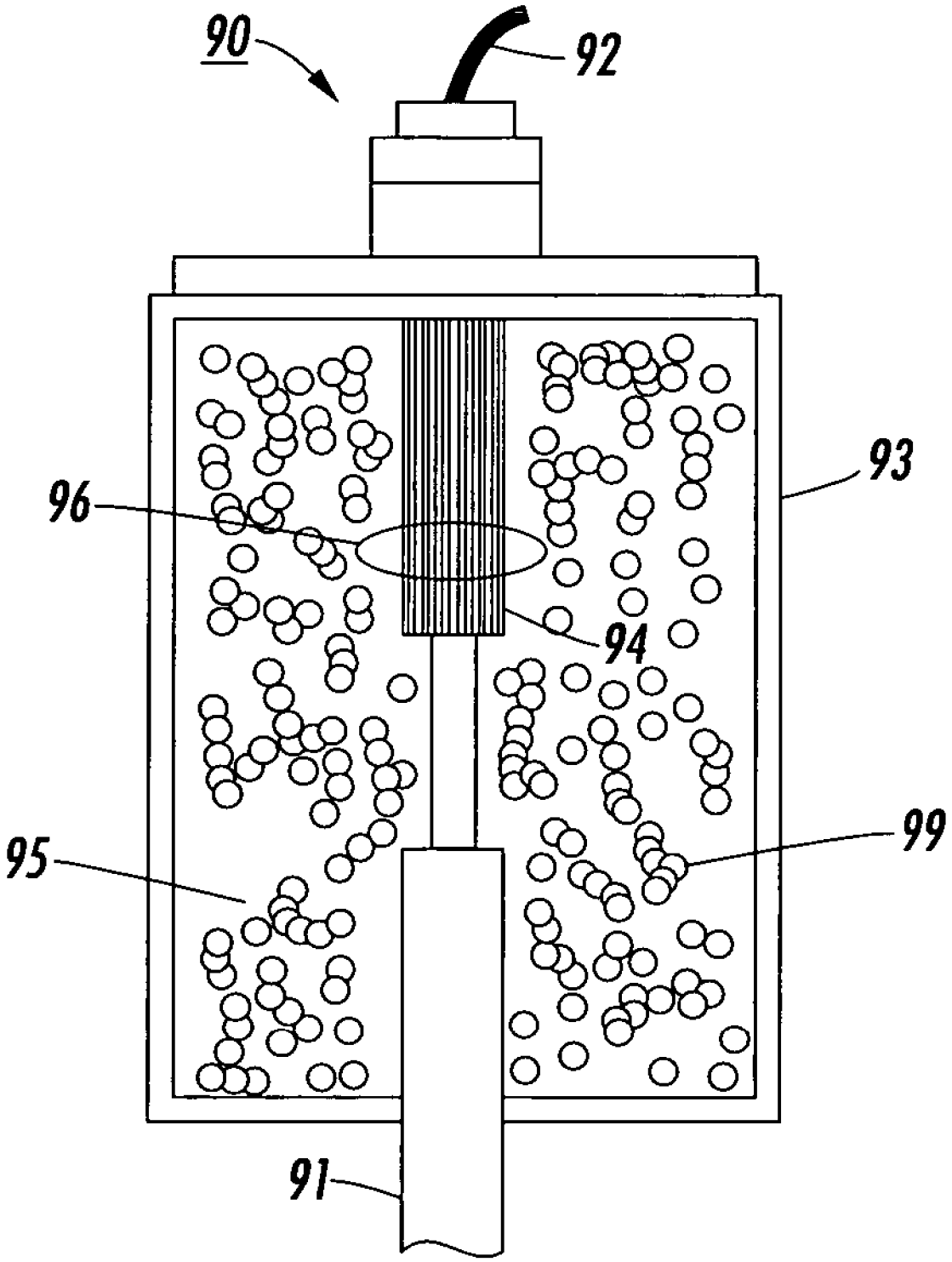
FIG. 3 is a partial schematic side view of the magneto rheological variable clutch used in the retard feeder apparatus of FIG. 2.

Improved performance of retard roll 53 is obtained by varying torque force applied thereto with the use of a magneto rheological clutch 90 as shown in FIG. 3. Magneto rheological clutch 90 generates a drag torque, which is varied by changing the current 92 supplied to it. The clutch contains magneto rheological fluids 95 positioned within a casing or housing 93 mounted on a shaft 91. Magneto rheological fluid is disclosed in U.S. Pat. No. 5,906,767 to Lord Corporation, Cary, N.C. The fluids have magnetizable particles 99 in oil, which in the presence of a magnetic field 96, can solidify. The magnetic field can be controlled by varying the current supply to it, hence in turn, controlling the amount of drag torque produced. The magnetic field is generated using an electromagnet 94. Hence, the magnetic field can be varied with current so that the amount of drag torque produced can be controlled.

Figure 4:
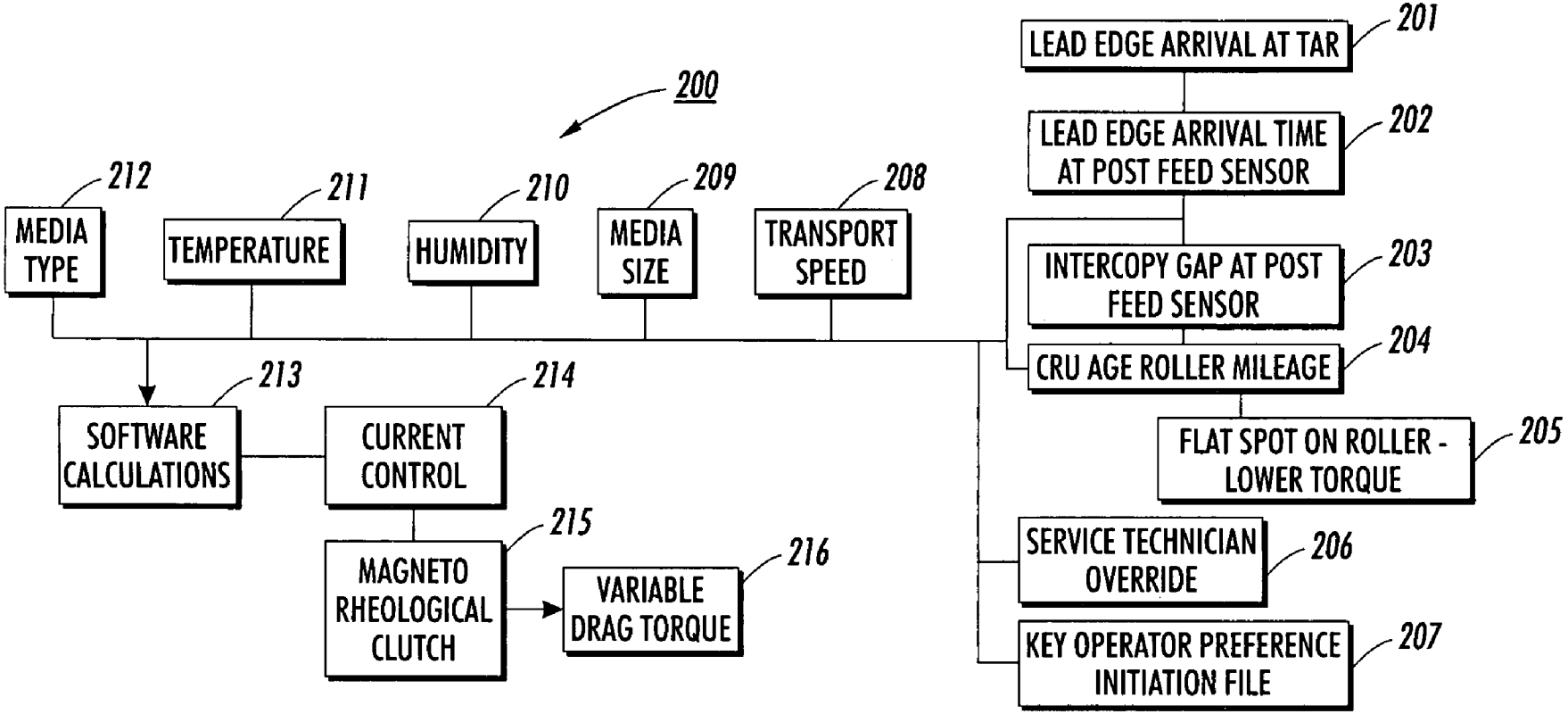
FIG. 4 is a block diagram indicating various inputs, outputs and overrides to the magneto rheological variable clutch of FIG. 3.
Figure 5:
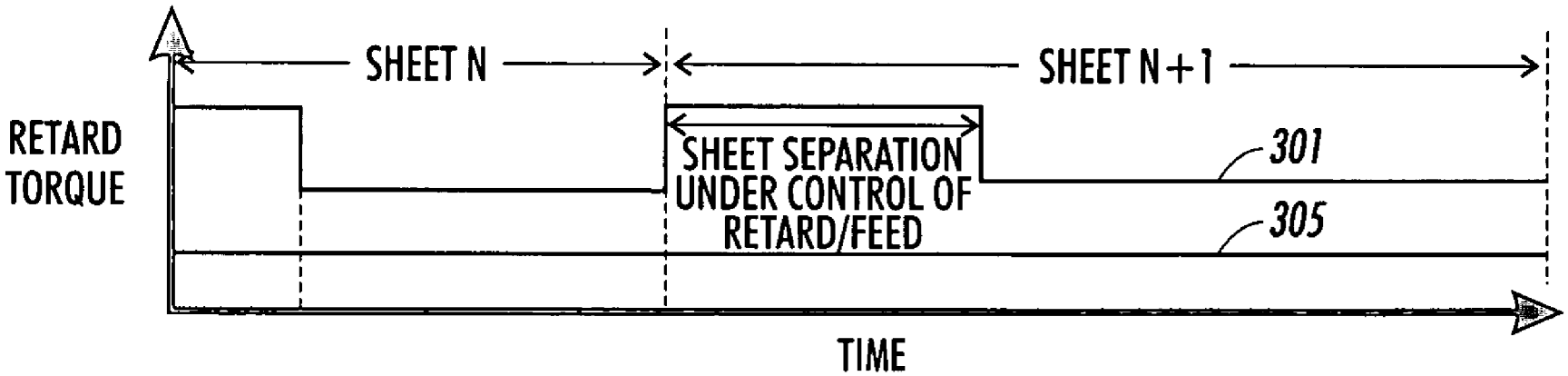
FIG. 5 is a chart showing the difference in torque required to feed sheets with a retard feed head including a magneto rheological variable clutch vs. a wrap spring clutch.

Block diagram 200 of FIG. 4 discloses the various parameters that are used to set the default settings for magneto rheological clutch 90. Coarse adjustment parameters define the starting range of current sent by controller 29 to magneto rheological clutch 90 and include block 212 of media type. This can be known by operator input through graphic user interface (GUI) 25 or deduced from the copier/printer's operating mode. For example: a) when the operator selects color scan, it indicates that the document is on color coated stock; b) a duplex job is likely to indicate that the job is using two sided coated stock when a wax color image is face to face; or c) lightweight paper with a mono image is fairly easy to separate, but is susceptible to de-lamination damage. This type of damage is addressed, as shown in FIG. 5, with the disclosed variable torque magneto rheological clutch 90. In line 301, torque is at one level while sheet separation is under control of the retard/feed mechanism and is reduced once the sheet is under control of the takeaway rolls, thus relieving the pressure on the sheet and minimizing de-lamination of the sheet. Line 305 indicates that in conventional wrap spring retard nips, the torque remains the same throughout feeding and thereby contributes to sheet de-lamination.

Another input toward fine tuning the magneto rheological clutch is media size in block 209. Conventional sheet size sensors (not shown) in the printer of FIG. 1 are used to adjust retard roll torque for optimum performance in order to feed 11×17 inch sheets as easily as 8.5×5.5 inch sheets. An additional input in block 208 is paper transport speed. Transport speed information is place into the non-volatile memory of controller 29 at the factory. In blocks 210 and 211 environmental inputs for humidity and temperature are shown. These inputs can come from instruments built into the printer or from assumptions placed into the non-volatile memory of controller 29 at the factory based on site location of the printer.

Fine tuning adjustments of current to magnetic rheological clutch 90 are obtained with lead edge arrival time at the take away rolls in block 201, lead edge arrival time at post feed sensor 58 in block 202, measured intercopy gap at post feed 58 sensor in block 203, customer replaceable unit roller mileage in block 204, and sensing whether a flat spot is on the retard roller as shown in block 205. Overrides are also built into the system for a service technician as shown in block 206, as well as, for a key operator preference initiation file, i.e., setup to handle input from other equipment at the customer site. Use of lead edge arrival time at the takeaway rolls and post feed sensor as fine tune adjustments for current into the magneto rheological clutch will reduce the amount of time the retard roller is under load, which will increase life of the roller. By measuring arrival times at the post feed sensor, the intercopy gap can be determined. The intercopy gap gives an indication as to how well the feed head is performing. With these measurements, computer 29 can adjust current to the magneto rheological clutch based upon "time to feed". The customer replaceable unit (CRU) includes the feed/retard/nudger roll set and is replaced at specified intervals as part of maintenance on the paper feeders. Flat spots on a retard roll is sensed by controller 29 when it reaches the point where it will not roll and a message is sent to GUI 25 that alerts the customer to change the CRU. The time between replacing the CRU is lengthened with use of the variable magneto rheological clutch of the present disclosure because the torque to the retard roll will be reduced over the life of the unit to compensate for diameter reduction.

Both coarse adjustments and fine tune adjustments are processed in block 213 by controller 29 and based on these calculations current is controlled in block 214 to magneto rheological clutch 90 as shown in block 215 to produce a variable drag torque on retard roll 53 as shown in block 216.

Numerous advantages are enabled with the use of the magneto rheological clutch 90 within retard roll 53 that are not available presently. For example, the magneto rheological fluid can be operated from low voltage supplies. In addition, environmental changes do not effect the magnetic rheological fluids in a significant way. Also, the viscosity of the magneto rheological fluids can be charged in less than 10 milliseconds enabling almost instantaneous response time. Further, the amount of current to the electromagnet can be altered according to the type of paper, size of paper or various environmental conditions, such as, humidity, contaminated environment, temperature, etc. Further yet, the magneto rheological clutch aids in increasing the life of the other parts that have to be replaced after a specified time because the clutch compensates for wear of rollers and loss in coefficient of friction by increasing the drag torque it applies, hence prolonging the life of various parts. An additional advantage of the magneto rheological clutch of the present disclosure is that it can be used to lower the drag torque of the retard roller when the top sheet reaches the takeaway rolls. This results in a reduction in induced skew.

While the disclosed magneto rheological clutch has been described with reference to a paper feeder, it should be understood that the clutch would work equally well in document handlers, sheet interposers, facsimile machines or any machine that feeds sheets with the aid of a retard roll. Also, the disclosed magneto rheological clutch could be used within a system's drive train. This device has an advantage over the conventional design approach of an electromagnetic clutch with gear or timing belt reduction. The magneto rheological clutch can have a 'soft' start feature to prevent torque or velocity transients when the drive is switched ON or OFF. Use of gear or timing belt reduction can be avoided by providing speed feedback of the load and adjusting the magneto rheological magnetic field to maintain a desired speed. Additionally, a continuously variable gear ratio can be provided with suitable speed sensing feedback. Further, the magneto rheological clutch can provide some damping which is helpful for reducing vibration and noise in stepper motor drive trains.

Figure 6:
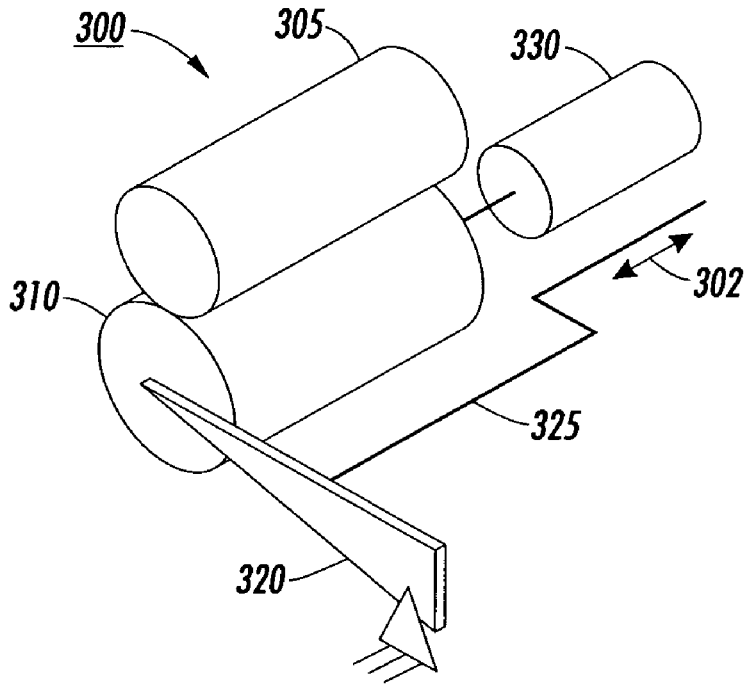
FIG. 6 is a partial, exploded schematic of a passive self-adjusting embodiment of a retard feeder that includes an adjustable hysteresis clutch.
Figure 7:
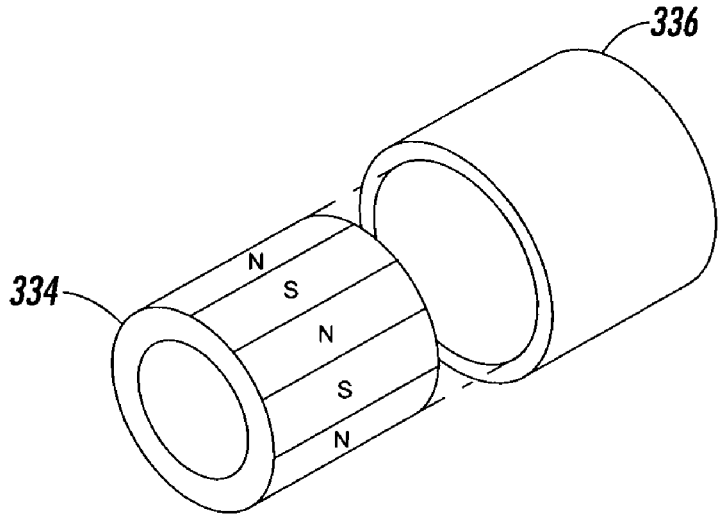
FIG. 7 is a partial, exploded schematic showing a permanent magnet rotor and a metal cylinder used to vary the torque in the hysteresis clutch of FIG. 6.

Alternatively, in the embodiment of the disclosure in FIGS. 6 and 7, a compensating torque retard feeder 300 is shown comprising a separation roller 305 that forms a sheet feeding nip with retard roll 301. Retard roll 301 is attached to a conventional pivoting retard bracket, such as, shown in U.S. Pat. No. 6,595,512 B2, which is included herein by reference, and loaded against separation roll 305. A resisting torque to retard roll 310 is provided by hysteresis clutch 330. As shown in FIG. 7, hysteresis clutch 330 includes a permanent magnet rotor 334 with multiple axial magnetic poles and a metal cylinder 336 positioned thereover. Rotation of the rotor relative to the cylinder creates a changing magnetic field. This induces currents in the ring, which oppose the motion producing the retard torque. Metal cylinder 336 is moveable over the surface of permanent magnet rotor 334 in the directions of arrow 302. The amount of overlap of the rotor and cylinder determines the resisting torque to retard roll 310.

A link conventional 325 connects retard bracket 310 and a retard bracket (not shown) on the opposite side of retard roll 310, as well as, to metal cylinder 336. As retard roll 310 wears and the diameter changes, and thus, the angle of the brackets change. This, change in angle of the brackets controls movement of cylinder 336, which in turn, varies the penetration of permanent magnet rotor 334 into the magnetic cylinder, thereby decreasing the torque, as the retard roll 310 wears. This allows the resisting force to be constant as the retard roll wears.

While the angle of the retard bracket is shown mechanically controlling the amount of overlap of the rotor and magnetic cylinder in the hysteresis clutch in a passive, self adjusting embodiment, it should be understood that an active embodiment could be used, if desired, by replacing the linkage from the retard bracket to the clutch with a motorized servo motor type system.

It should now be understood that an improved retard paper feed system has been disclosed that employs a controllable torque device in the separation nip. The Controllable torque device is a clutch on which a retard roll is mounted with the clutch including a magneto rheological fluid. The magneto rheological fluid has magnetizable particles therein which, in the presence of a magnetic field, becomes more viscous. The magnetic field is controlled by varying current supplied to it.

Hence, it in turn controls the amount of drag torque produced on the retard roll. The drag torque on the retard roll is adjusted to an optimum value for changes in the type of paper being fed, size of paper being fed and environmental conditions, such as, humidity and temperature. Alternatively, the property of a hysteresis clutch can be utilized in a compensating torque retard feeder to decrease the applied torque on a retard roll as the retard roll wears. This system will allow large elastomeric material wear with low rates of change of the applied retard force.

It will be appreciated that various of the above-disclosed and other features and functions, or alternatives thereof, may be desirably combined into many other different systems or applications. Also, that various presently unforeseen or unanticipated alternatives, modifications, variations or improvements therein may be subsequently made by those skilled in the art which are also intended to be encompassed by the following claims.

What is claimed is:

1. A reprographic device, comprising:

a scanning member for scanning a document;

an image processor that receives image data from said scanning member and processing it;

a retard sheet feeder, said retard sheet feeder including a retard roll and a separation roll that forms a nip therebetween to feed copy sheets to receive images thereon from said image processor, a post feed sensor and take away rolls, said retard sheet feeder including a clutch mechanism that applies a variable drag torque to said retard roll, and wherein said variable drag torque of said clutch mechanism is controlled by a controller, and wherein said controller makes coarse adjustments to the torque of said clutch mechanism based on media type, temperature, humidity, media size and sheet transport speed inputs and fine tune adjustments to said torque of said clutch mechanism based on lead edge arrival time of copy sheets at said take away rolls, lead edge arrival time of copy sheets at said post feed sensor, intercopy gap at said post feed sensor and wear of said retard roll as inputs; and at least one output tray for receiving imaged copy sheets.

2. The reprographic device of claim 1, wherein said clutch mechanism includes a magneto rheological fluid.

3. The reprographic device of claim 2, wherein said clutch mechanism includes an electro magnet positioned within said magneto rheological fluid.

4. The reprographic device of claim 3, wherein said magneto rheological fluid includes magnetizable particles in oil.

5. The reprographic device of claim 1, wherein said torque on said retard roll is reduced once a copy sheet reaches said takeaway rolls.

6. The reprographic device of claim 1, wherein said fine tune adjustments are made during a print job.

7. An electrostatographic printing apparatus, comprising:

a document handler that receives and feeds documents from a feed tray along a predetermined feed path;

a scanning member positioned to read an image on each document fed through said predetermined feed path and forwards image data for further processing;

an image processor that receives the image data from said scanning member and processing it;

a retard sheet feeder, said retard sheet feeder including a retard roll and a separation roll that forms a nip therebetween to feed copy sheets to receive images thereon from said image processor, said retard sheet feeder including a clutch mechanism that applies a variable torque to said retard roll;

a controller adapted to control said variable torque of said clutch mechanism based on media type, temperature, humidity, media size and sheet transport speed inputs; and at least one output tray for receiving the imaged copy sheets.

8. The electrostatographic printing apparatus of claim 5, wherein said retard sheet feeder includes takeaway rolls, and wherein the torque on said retard roll is reduced once a sheet reaches said takeaway rolls.

9. The electrostatographic printing apparatus of claim 5, wherein said clutch mechanism includes a magneto rheological fluid.

10. The electrostatographic printing apparatus of claim 7, wherein said computer makes fine tune adjustments to controlling said torque of said clutch mechanism based on lead edge arrival time of copy sheets at said take away rolls, lead edge arrival time of copy sheets at a post feed sensor, intercopy gap of copy sheets at said post feed sensor and wear of said retard roll as inputs.

11. The electrostatographic printing apparatus of claim 10, wherein said fine tune adjustments are made during a print job.

12. A method in an apparatus for controlling torque on a retard roll, comprising:

providing a scanning member for scanning a document;

providing an image processor that receives image data from said scanning member and processing it;

providing a retard sheet feeder, said retard sheet feeder including a retard roll and a separation roll that forms a nip therebetween to feed copy sheets to receive images thereon from said image processor and take away rolls, said retard sheet feeder including a clutch mechanism that applies a variable torque to said retard roll;

providing a computer for controlling said variable torque of said clutch mechanism;

applying said variable torque based upon inputs to said computer of media type, temperature, humidity, media size and sheet transport speed; and at least one output tray for receiving imaged copy sheets.

13. The method of claim 12, including making fine tune adjustments to controlling said torque of said clutch mechanism with said computer based on lead edge arrival time of copy sheets at said take away rolls, lead edge arrival time of copy sheets at a post feed sensor, intercopy gap of copy sheets at said post feed sensor and wear of said retard roll as inputs.

14. The method of claim 13, including providing an override to lock out said fine tune adjustments and set defaults to suit a particular requirement.

15. The method of claim 13, further providing said fine tune adjustments during a print job.

* * * * *